US008553843B2

(12) United States Patent
Drory

(10) Patent No.: US 8,553,843 B2
(45) Date of Patent: Oct. 8, 2013

(54) ATTACHMENT OF A HIGH-Z FOCAL TRACK LAYER TO A CARBON-CARBON COMPOSITE SUBSTRATE SERVING AS A ROTARY ANODE TARGET

(75) Inventor: Michael David Drory, Dublin, NH (US)

(73) Assignee: Koninklijke Philips N.V., Eindhoven (NL)

( * ) Notice: Subject to any disclaimer, the term of this patent is extended or adjusted under 35 U.S.C. 154(b) by 149 days.

(21) Appl. No.: 13/139,349

(22) PCT Filed: Dec. 14, 2009

(86) PCT No.: PCT/IB2009/055740

§ 371 (c)(1), (2), (4) Date: Jun. 13, 2011

(87) PCT Pub. No.: WO2010/070574

PCT Pub. Date: Jun. 24, 2010

(65) Prior Publication Data

US 2011/0249803 A1 Oct. 13, 2011

Related U.S. Application Data

(60) Provisional application No. 61/138,167, filed on Dec. 17, 2008.

(51) Int. Cl.
*H01J 35/10* (2006.01)
*H01J 35/08* (2006.01)

(52) U.S. Cl.
USPC ..... 378/125; 378/143; 378/144

(58) Field of Classification Search
USPC ..... 378/113, 119, 124, 125, 143, 144
See application file for complete search history.

(56) References Cited

U.S. PATENT DOCUMENTS

| | | | |
|---|---|---|---|
| 1,893,759 | A | 4/1927 | Bouwers |
| 1,977,827 | A | 10/1932 | Kneller |
| 2,121,631 | A | 5/1936 | Gross et al. |

(Continued)

FOREIGN PATENT DOCUMENTS

| | | | |
|---|---|---|---|
| DE | 19650061 | A1 | 12/1996 |
| EP | 0436983 | A1 | 7/1991 |
| FR | 2593325 | A1 | 7/1987 |

*Primary Examiner* — Irakli Kiknadze

(57) ABSTRACT

The present invention refers to hybrid anode disk structures for use in X-ray tubes of the rotary anode type and is concerned more particularly with a novel light weight anode disk structure (RA) which comprises an adhesion promoting protective silicon carbide (SiC) interlayer (SCI) deposited onto a rotary X-ray tube's anode target (AT), wherein the latter may e.g. be made of a carbon-carbon composite substrate (SUB'). Moreover, a manufacturing method for robustly attaching a coating layer (CL) consisting of a high-Z material (e.g. a layer made of a tungsten-rhenium alloy) on the surface of said anode target is provided, whereupon according to said method it may be foreseen to apply a refractory metal overcoating layer (RML), such as given e.g. by a tantalum (Ta), hafnium (Hf), vanadium (V) or rhenium (Re) layer, to the silicon carbide interlayer (SCI) prior to the deposition of the tungsten-rhenium alloy. The invention thus leverages the tendency for cracking of the silicon carbide coated carbon composite substrate (SUB') during thermal cycling and enhances adhesion of the silicon carbide/refractory metal interlayers to the carbon-carbon composite substrate (SUB') and focal track coating layer (CL) by an interlocking mechanism. Key aspects of the proposed invention are: a) controlled formation of coating cracks (SC) in the silicon carbide layer (SCI) and b) conformal filling of SiC crack openings with a refractory metal.

18 Claims, 5 Drawing Sheets

(56) References Cited

U.S. PATENT DOCUMENTS

| | | | | | |
|---|---|---|---|---|---|
| 2,336,271 | A | | 12/1943 | Machlett et al. | |
| 2,863,083 | A | | 3/1957 | Schram | |
| 2,942,126 | A | | 12/1957 | Silbermann | |
| 3,329,601 | A | | 7/1967 | Mattox | |
| 3,579,022 | A | | 5/1971 | Hennig et al. | |
| 4,637,042 | A | | 1/1987 | Braun | |
| 4,645,121 | A | * | 2/1987 | Devine, Jr. | 228/194 |
| 4,715,055 | A | * | 12/1987 | Devine, Jr. | 378/144 |
| 4,939,762 | A | | 7/1990 | Baba et al. | |
| 4,972,449 | A | | 11/1990 | Upadhya et al. | |
| 5,055,318 | A | | 10/1991 | Deutchman et al. | |
| 5,099,506 | A | | 3/1992 | Van Der Kooi et al. | |
| 5,138,645 | A | | 8/1992 | Penato et al. | |
| 5,498,187 | A | | 3/1996 | Eggleston et al. | |
| 5,943,389 | A | | 8/1999 | Lee | |
| 6,430,264 | B1 | | 8/2002 | Lee | |
| 6,554,179 | B2 | | 4/2003 | Horner et al. | |

* cited by examiner

ATTACHMENT OF A HIGH-Z FOCAL TRACK LAYER TO A CARBON-CARBON COMPOSITE SUBSTRATE SERVING AS A ROTARY ANODE TARGET

FIELD OF THE INVENTION

The present invention refers to hybrid anode disk structures for use in X-ray tubes of the rotary anode type and is concerned more particularly with a novel light-weight anode disk structure which comprises an adhesion promoting protective silicon carbide interlayer deposited onto a rotary X-ray tube's anode target, wherein the latter may e.g. be made of a carbon-carbon composite substrate. Moreover, a manufacturing method for robustly attaching a coating layer consisting of a high-Z material (e.g. a layer made of a tungsten-rhenium alloy) on the surface of said anode target is provided, whereupon according to said method it may be foreseen to apply a refractory metal overcoating layer, such as given e.g. by a tantalum, hafnium, vanadium or rhenium layer, to the silicon carbide interlayer prior to the deposition of the tungsten-rhenium alloy. The invention thus leverages the tendency for cracking of the silicon carbide coated carbon composite substrate during thermal cycling and enhances adhesion of the silicon carbide/refractory metal interlayers to the carbon-carbon composite substrate and focal track coating layer by an interlocking mechanism. Key aspects of the proposed invention are: a) controlled formation of coating cracks in the silicon carbide layer and b) conformal filling of silicon carbide crack openings with a refractory metal.

BACKGROUND OF THE INVENTION

X-ray tubes for medical diagnostic equipment typically make use of the inventions as claimed and described in U.S. Pat. No. 2,121,631, U.S. Pat. No. 2,336,271, U.S. Pat. No. 2,863,083 and U.S. Pat. No. 2,942,126 or similar applications. Conventional X-ray tubes for high power operation typically comprise an evacuated chamber which holds a cathode filament through which a heating or filament current is passed. A high voltage potential, usually in the order between 40 kV and 160 kV, is applied between the cathode and an anode which is also located within the evacuated chamber. This voltage potential causes electrons emitted by the cathode to be accelerated in the direction of the anode. The emitted electron beam then impinges on a small area (focal spot) on the anode surface with sufficient kinetic energy to generate X-ray beams, the latter consisting of high-energetic photons ejected by said anode, which can then e.g. be used for medical imaging or material analysis. The interaction of the electron beam and anode requires to use high-Z focal track materials, such as tungsten and tungsten-rhenium alloys.

However, it should be noted that this method of X-ray generation is extremely inefficient, which is due to the fact that most of the electric power which is applied to an X-ray tube is converted into heat and because one of the most important power limiting factors of nowadays high power X-ray tubes is the melting temperature of the employed anode material. Conversion efficiency from electron beam power to X-ray power is at maximum between about 1% and 2%, but in many cases even lower. Consequently, the anode target of a high power X-ray tube carries an extreme heat load, especially in the range of the anode target's focal spot, a relatively small target area sub-surface volume covering a surface area with a size of about a few square millimeters, which would lead to the destruction of the anode if no special measures of heat management were taken.

Efficient heat dissipation thus represents one of the greatest challenges faced in the development of current high power X-ray tubes. At the same time, a small focal spot size is required for high spatial resolution of the imaging system, which leads to very high energy densities at the focal spot. Therefore, tube designs are usually highly tailored for heat dissipation and thermal management capability, notably by high speed rotation of the anode about a fixed cathode and by the use of temperature control (via high thermal conductivity and emissivity) bulk materials and coatings. In particular, conventional thermal management techniques for X-ray anodes as known from the prior art may include

- using materials that are able to resist very high temperatures,
- using materials that are able to store a large amount of heat, as it is difficult to transport the heat out of the vacuum tube,
- enlarging the thermally effective focal spot area without enlarging the optical focus by using a small angle of the anode, and
- enlarging the thermally effective focal spot area by rotating the anode.

Except for high power X-ray tubes with a large cooling capacity, using X-ray tubes with a moving target (e.g. a rotary anode) is very effective. It relies on thermal conduction and radiation as thermal transport mechanisms since convection does occur in the evacuated tube. Compared to stationary anodes, X-ray tubes of the rotary-anode type offer the advantage of quickly distributing the thermal energy that is generated in the focal spot such that damaging of the anode material (e.g. melting or cracking) is avoided. Rotation thereby allows for thermal conduction and radiation to avoid local melting of the anode target area. This permits an increase in power for short scan times which, due to wider detector coverage, went down in modern CT systems from about 30 seconds to 3 seconds. The higher the velocity of the focal track with respect to the electron beam, the shorter the time during which the electron beam deposits its power into the same small volume of material and thus the lower the resulting peak temperature.

High focal track velocity is accomplished by designing the anode as a rotating disk with a large radius (e.g. about 20 cm) and rotating this disk at a high frequency (e.g. at more than 150 Hz). However, as the anode is rotating in a vacuum, the transfer of thermal energy to the outside of the tube envelope depends largely on radiation, which is not as effective as the liquid cooling used in stationary anodes. Rotary anodes are thus designed for high heat storage capacity and for good radiation exchange between anode and tube envelope. The problem of dissipating the heat from a rotary anode tube is of such major importance that it has received attention over a period of many years and various methods for obtaining rapid dissipation of heat have been suggested and presented in the relevant literature.

Another difficulty associated with rotary anodes is the operation of a bearing system under vacuum and the protection of this system against the destructive forces of the anode's high temperatures. In the early days of rotary anode X-ray tubes, limited heat storage capacity of the anode was the main hindrance to high tube performance. This has changed with the introduction of new technologies. For example, graphite blocks brazed to the anode may be foreseen which dramatically increase heat storage capacity and heat dissipation, liquid anode bearing systems (sliding bearings) may provide heat conductivity to a surrounding cooling oil, and providing rotating envelope tubes allows direct liquid cooling for the backside of the rotary anode.

The first use of a rotary anode X-ray tube provides the basis for further improvements in the apparatus, one of which is provided in the present invention. The earliest use of a rotary anode in an X-ray tube is provided in U.S. Pat. No. 1,893,759, issued in January 1933. What is described is a rotary anode, therein referred to as an anti-cathode, which comprises a tungsten conical rod, hollowed to allow attachment to a copper sleeve and two ball bearings and rotating about a copper inner rod. All the essential features of the rotary anode X-ray tube are already provided in this prior-art document: a) encapsulation of the X-ray emitting device into a single glass enclosure, b) use of a tungsten cathode, c) use of a rotary anode (anti-cathode) to allow for higher X-ray emission by virtue of avoiding local heating that otherwise occurs on a stationary anode, d) a two-bearing axial attachment of the anode to copper (Cu) for external heat transfer, and e) incorporation of a copper cylinder to form the motor stator for rotation. In this early invention, the motor has entirely encapsulated in vacuo by the glass enclosure.

The concept of an inlayed focal track in the rotary anode member is e.g. described in U.S. Pat. No. 1,977,275. The apparatus involved tungsten (W) or molybdenum (Mo) incorporated in a copper alloy sleeve to increase heat transfer over a single piece of tungsten. The apparatus employs a copper-graphite alloy to provide in vacuo lubrication to the two bearing system. Sliding bearings of the graphite-containing copper alloy are used rather than the previous invention with ball bearings to reduce the noise level of the device containing ball bearings. The rotary anode target is formed with the inlayed focal track by heat shrink fitting the copper alloy sleeve onto the bearing assembly, the latter containing a bolted joint cylinder with the copper alloy sleeve bearings. Current devices have returned to ball bearings to realize a much greater surface velocity associated with high-speed rotation of the anode target. Present devices incorporate other lubricating means, such as silver (Ag) and lead (Pb) coatings onto the bearing elements prior to X-ray tube assembly, most often the balls. A bolted joint connection between the anode target and bearing assembly is also a common feature in current practices (see e.g. U.S. Pat. No. 5,498,187).

As described above, initial inventions for rotary anode target in X-ray tubes, such as e.g. U.S. Pat. No. 2,121,631, utilized an all-refractory metal target for maximizing the X-ray generation while exploiting the high melting temperature of this class of metals. However, it is undesirable to use only one refractory metal (e.g. tungsten) or its alloys as the anode target as a result of high cost, extreme room temperature brittleness, and high density.

This is particularly the case for a tungsten anode which maximizes the relative X-ray photon generation by virtue of a high atomic number Z.

Several inventions lead to improvements in the anode target to reduce overall weight, cost, and dramatically increase the photon flux from the X-ray generation source by increased target radius (hence focal track circumference), heat dissipation capability, and effective increases in the lifetime of the apparatus. Concomitant improvements in other sections of the X-ray tube design (e.g. cathode, use of novel materials) have allowed achievement of these goals.

X-ray anode targets used in present day Computerized Tomography (CT) medical imaging scanners utilize the same basic invention of the rotary anode configuration with a fixed tungsten filament cathode, but rely on an anode target disk of a titanium-zirconium-molybdenum (TZM) alloy containing a continuous track of a tungsten-rhenium (W/Re) alloy towards the outer anode radius. TZM alloys satisfy several critical design requirements for the anode X-ray target without relying on a single tungsten-rhenium alloy structure: a) relatively high strength, b) high melting temperature, c) rapid thermal conduction of heat from the electron beam impingement upon the W/Re track with high kinetic energy provided by a potential difference of about 100 kV, d) electrical conductivity, and e) large mechanical loads caused by rotation at 10,000 rpm and gyroscopic acceleration and de-acceleration loads on the CT scanner gantry.

Improvements in cardiac imaging require the use of higher speed CT gantry rotation, below 0.3 seconds per revolution. This translates into faster speed of the rotary anode target to exceed 30,000 rpm, which is not attainable with the prior art since overloading occurs for a variety of components in the X-ray tube; namely, anode target, target attachment, and cantilever bearing system. Reducing the weight of the anode target reduces the load for each of these issues and may permit even faster gantry scanning rates, subsequently higher target rotation speeds. A carbon-carbon composite is favored for a light-weight anode target material since it has very low density, high specific strength, high temperature use capability and successful use in demanding load and elevated temperatures applications. Nominal physical and mechanical properties of carbon-carbon composites are listed in Table 2 at room temperature (r.t.) and elevated temperatures (see ASM International, *ASM Engineered Materials Reference Book,* $2^{nd}$ Ed., 1994).

The application of carbon-carbon composite structures allows to combine the knowledge and experience from previous rotary anode X-ray target designs with the use of carbon-carbon composites in fields other than diagnostic medical imaging. Previous developments are separated here for convenience into (a) development and invention of the substrate material, and (b) adherent protective coatings for carbon composites. Specifically, the development of carbon-carbon composite substrate materials in which carbon-fiber reinforced carbon matrix composites were first developed for rocket components (cf. Buckley, J. D., Edie, D. D., *Carbon-Carbon Materials and Composites*, Noyes Publications, 1993) and later commercialized as high-friction/low-density materials for aircraft brakes (see Windhorst, T. and Blount, G., *Materials and Design,* 18[1] (1997) 11). Coating of carbon composites is a major materials development goal for carbon composite coatings to provide high temperature oxidation resistance for the reinforcement fibers and carbon matrix and for component attachment. Metal alloys and inorganic compounds have been utilized for this purpose, providing prior art applicable to the development of carbon composites for anode targets. Coating of carbon composites is taught for use in a wide variety of applications requiring reliable operation in extreme conditions, such as e.g. rocket nozzle components, fusion reactor containment walls and other critical components, microwave tubes, heat exchangers, and submarine hull designs.

An adherent refractory metal coating to carbon composites forms the focal track area for X-ray generation for the rotary anode and is of vital importance in the application of carbon-based substrates for use in X-ray tubes. We also learn key aspects of the previous anode design described above in the prior art and apply it to the use of carbon-carbon composites for a rotating X-ray anode substrate, namely: a) bonding of a thin focal track material onto solid metal targets, b) bonding of a refractory metal onto a solid graphite target, and c) bonding of a graphite ring onto a molybdenum alloy cap. The prior art for coating attachment will be examined here from all available uses and compared with issued patents and pending applications relating to carbon composite materials for rotary anode X-ray targets.

In U.S. Pat. No. 6,554,179, the focal track attachment issue is directly addressed for the X-ray tube application with a carbon-carbon composite substrate. Green-state slurries of powder layers are applied to the carbon composite and fired at high temperature to achieve a tailored interface with a refractory metal top layer as the focal track. The bonding layers include carbides or borides of hafnium (Hf) and zirconium (Zr) powders, combined with these powders or thin foils in elemental forms. The process in the preferred embodiments involves formation of a layered stack followed by a single high temperature firing step in a vacuum or inert gas: a) application of the initial powder slurry containing hafnium or zirconium carbides or borides with hafnium or zirconium powder, b) drying at 125° C., c) addition of a hafnium or zirconium thin foil or powder, d) added power layer of refractory metal such as e.g. tungsten (W) and molybdenum (Mo) for the focal track, e) light compaction pressure, and f) firing for at least fifteen minutes at high temperatures for densification. U.S. Pat. No. 6,554,179 teaches that including hafnium and zirconium powder incorporated in the carbide or boride slurry lowers the sintering temperature to a temperature between 1,700° C. and 1,900° C. from higher temperature firing at 2,350° C. with slurry devoid of the elemental powders. In contrast, one form of the embodiment as described in U.S. Pat. No. 6,554,179 involves high temperature firing at 2,350° C. of interlayers followed by a second 2,350° C. firing with the additional of focal track powders applied at the top surface.

U.S. Pat. No. 5,943,389 addresses the need for a carbon-carbon composite substrate through a hybrid approach of using a graphite substrate and attaching a high thermal conductivity array of carbon fibers embedded in a multilayer stack for mitigating the thermal expansion mismatch between the focal track and carbon materials. This involves using a forest of about 10% to 40% volume of thin chopped carbon fibers perpendicular to a carbon substrate, and embedded in several functional layers: a) bonding layer between the fiber ends and the carbon substrate (although it remains undetermined as to the best method for the alignment and attachment procedure), b) rhenium overcoating of the carbon fibers to form a 3 μm to 5 μm diffusion barrier to the high-Z focal track materials, and c) a mixture of tungsten (W), tungsten-rhenium (W/Re), hafnium carbide (HfC), tantalum carbide (TaC), zirconium carbide (ZrC) and niobium carbide (NbC) to fill between the coated carbon fiber and overlay a continuous layer which incorporates the carbon fiber array. The high-Z elements, alloys and carbides are varied to accommodate the thermal expansion mismatch between the carbon substrate, fiber composite layer, and high-Z focal track. High-thermal conductivity carbon fibers with a diameter between 8 μm and 12 μm and having a length between 0.003 inches and 0.030 inches (which means between about 80 μm and 800 μm) are used in the preferred embodiment.

Although U.S. Pat. No. 5,943,389 teaches to incorporate short fiber composites into a layer with tailored thermal expansion materials, there is not disclosed any method of fiber placement and attachment to the carbon substrate; a particularly important issue since carbon fibers are commonly available in tows consisting of at least 10,000 fibers. Rhenium (Re) is chosen in U.S. Pat. No. 5,943,389, as the carbon-diffusion barrier attached to the carbon fibers is a stated reason of expected low solubility of carbon in rhenium, thermal matching with the carbon fiber and small decrease in thermal conduction from the focal track to the fiber array. Fundamentally, rhenium is more likely to be a good choice for the interlayer since there is rhenium carbide formation at the focal track temperatures exceeding 2,000° C. The conversion rate to rhenium carbide remains unknown but can be determined in time-temperature exposure experiments, and the X-ray photoelectron spectroscopy (XPS) depth profile of a thin rhenium foil bonded at high temperature to a carbon substrate in vacuum and under a low load.

In U.S. Pat. No. 6,430,264, the use of a carbon-carbon composite as a light-weight rotary anode target is described as well as the design and method for producing the focal track. Distinction is made from the carbon-carbon composite with existing designs with a TZM cap and graphite storage ring and with use of graphite as the anode target substrate. A carbon-carbon composite allows for a light-weight target to achieve higher accelerations and X-ray flux than feasible with a TZM/graphite target. Although use of a graphite substrate is also light-weight, it is pointed out that the strength of graphite is not sufficient for use as a substrate material at the speeds and accelerations needed in future CT systems. A carbon fiber reinforced carbon matrix substrate is preferred and cited in the claims as a result of light weight, high strength, thermal conductivity and current availability produced by chemical vapor deposition and infiltration methods. Attachment of the focal track to the carbon-carbon composite is described as following a roughing procedure for the annular region of the substrate in which the focal track materials are to be attached. One embodiment describes the use of a 1-2 μm layer of tantalum (Ta) followed by a 30 μm thick layer of rhenium (Re), and overcoating of the tantalum and rhenium layers with the tungsten-rhenium (W/Re) alloy of 0.010 inch (250 μm) thickness. Tantalum is selected as the interface to the carbon-carbon composite substrate, since it is a carbide forming compound at the focal track temperatures and owing to the required duration of use. It is envisaged that the entire tantalum layer will be converted to tantalum carbide (TaC) and provide a useful bonding layer between the focal track alloy and carbon-carbon anode substrate. Bonding will be further promoted by using a relatively thick layer of rhenium between the tantalum (hence converted to tantalum carbide) interlayer and tungsten-rhenium (W/Re) track. This provides for a carbon-diffusion barrier.

Although the science is not part of the claims in U.S. Pat. No. 6,430,264, we learn from prior art that the tungsten carbide forms a weak interface to a carbon-carbon composite substrate, and is to be avoided for a practical anode target, both in article fabrication and through the lifetime of the device where a measurable reaction rate between materials is likely. A rhenium interlayer is described in several previous inventions of a carbon-based anode target, such as e.g. in U.S. Pat. No. 3,579,022. Furthermore, U.S. Pat. No. 6,430,264 also cites the use of a single tantalum layer with a relatively large thickness (~10 μm) to form the focal track after conversion at high temperature to tantalum carbide. Several other carbide-forming bonding layers are provided in U.S. Pat. No. 6,430,264 (cf. claim 11) to have the same affect as a thin layer of tantalum (Ta)—the preferred embodiment—between the carbon substrate and a tungsten-rhenium focal track: hafnium (Hf), zirconium (Zr), niobium (Nb), titanium (Ti) and vanadium (V) along with their alloys.

SUMMARY OF THE INVENTION

In high-speed Computerized Tomography (CT) medical imaging equipment based on X-ray tubes of the rotary anode type, increasing diagnostic scanning rates necessitate the use of a light-weight anode target so as to avoid overloading of critical components contained within such a tube. This requires a robust attachment of high-Z focal track metal or alloy layers on the surface of said anode target. In contrast to conventional layer structures as commonly known from the relevant literature, whereupon it may e.g. be foreseen to use a light-weight carbon-carbon composite substrate as an anode target and attaching at least one relatively thin tungsten-rhenium layer forming a focal track to the substrate, the present invention additionally uses a silicon carbide interlayer deposited onto a carbon-carbon substrate. A refractory metal overcoating is applied to the silicon carbide layer prior to the deposition of the tungsten-rhenium alloy.

The invention thereby leverages current practices for carbon-carbon composites used for protection coatings in hypersonic vehicles, such as e.g. the Space Shuttle. Oxidation resistant coatings, e.g. silicon carbide are applied to leading edge materials, such as e.g. carbon-carbon composites. However, due to the thermal expansion difference between silicon carbide and carbon composites, coating cracks are prevalent from tensile stresses during the enormous temperature excursions realized in use. Coating cracks are filled by amorphous materials as part of the Shuttle maintenance cycle.

This methodology leads to the present invention of robust attachment for the X-ray tube application with reduced tendency for carbon diffusion. This is beneficial since carbon diffusion through the bonding layers to the tungsten-rhenium track may lead to an embrittlement of the anode target by formation of tungsten carbide (WC). Prior art on light-weight rotating X-ray anode targets use a carbon-carbon composite with carefully selected interlayers to promote adhesion between the substrate and the tungsten-rhenium focal track, along with avoiding carbon diffusion by incorporating a barrier interlayer.

In this context, a first exemplary embodiment of the present invention is thus dedicated to a light-weight hybrid anode disk structure for an X-ray tube of the rotary-anode type, wherein said anode disk structure comprises an anode target having a carbon composite substrate disk, an adhesion promoting protective interlayer vapor-deposited to an annular range on an inclined surface of said anode target, followed by a refractory metal overcoating layer attached on top of said silicon carbide interlayer, and a high-Z coating layer deposited onto top of said refractory metal overcoating layer, wherein said coating layer constitutes an X-ray emissive focal track when being exposed to an incident X-ray beam with sufficient kinetic energy.

According to the invention, it may preferably be foreseen that said coating layer is made of a tungsten-rhenium (W/Re) alloy. The refractory metal overcoating layer may e.g. be made of a tantalum (Ta), hafnium (Hf), vanadium (V) or rhenium (Re) layer, and the adhesion promoting protective interlayer may be realized as a silicon carbide (SiC) layer.

For example, the focal track area of the carbon-carbon composite substrate may be coated with a thin layer of silicon carbide having a thickness of 1 μm or less which may be deposited by vacuum coating methods, such as e.g. magnetron sputtering or ion-plating. The substrate may be heated during film deposition to temperature near 2,500° C. or greater to provide the stress-free condition of the coating as the maximum focal track temperature for the X-ray anode target. Heating of the substrate to high temperatures can thereby be achieved by a number of means in vacuum, such as e.g. by electron bombardment of a grounded substrate sample in high vacuum ($\sim 1 \cdot 10^{-6}$ torr) or in modest vacuum levels of between about 1 and 100 torr by ion bombardment in an inert gas plasma (e.g. argon) with a negative bias potential applied to the article.

The carbon composite substrate disk may be fabricated of a carbon composite having a thermal expansion coefficient lower than that of silicon carbide (SiC). For example, the carbon composite substrate disk may advantageously be made of a carbon fiber reinforced carbon matrix substrate which may e.g. comprise a number of incorporated polyacrylonitrile (PAN) fiber tows, carborized at approximately 1,500° C. and subsequently graphitized at a temperature between 2,500° C. and 3,000° C. 8. Alternatively, said carbon composite substrate disk may be made of mesophase pitch-based carbon fibers with carbon nanotube (CNT) reinforcements.

Carbon-carbon composites possess nearly all of the requisite properties for an anode target: a) low density, b) high strength, c) high temperature stability in excess of about 2,000° C., and d) high stiffness. The coefficient of thermal expansion of a carbon composite is low, typically about $1 \cdot 10^{-6}$° $C.^{-1}$, which creates challenges for joining metals with relatively high thermal expansion materials. The thermal expansion difference and temperature excursions experienced in the anode target fabrication and during use will create large thermally-induced stresses such that a bonding failure is likely without employing special methods that reduce the coating stress.

Carbon composite substrates are commercially available with two- and three-dimensional orientations of carbon fiber tows arranged in a pre-form and may be further tailored for additional reinforcement of the carbon matrix to operate under high centrifugal and gyroscopic loads and large temperature excursions. One example is the incorporation of carborized and graphitized polyacrylonitrile (PAN) fiber tows as mentioned above. The fibers possess the desirable combination of extreme values of elastic modulus, strength and thermal conductivity along the fiber tow axis. Typical properties of carbon-fiber tows are tensile modulus between 300 GPa and 600 GPa, tensile strengths between 3 GPa and 5 GPa, and room temperature thermal conductivity between 300 $W \cdot m^{-1} \cdot$° $C.^{-1}$ and 1,000 $W \cdot m^{-1} \cdot$° $C.^{-1}$. The carbon-carbon composite is formed by chemical vapor deposition and high temperature firing at about 2,500° C. Refractory metals are subsequently attached to the inclined region at the periphery of the target substrate. This inclined region is called the focal track and can e.g. be designed within the carbon fiber tow pre-form prior to carbon infiltration and densification or by post-fabrication machining.

Although the carbon composite surface is to be prepared with procedures to achieve the cleanliness and surface characteristics of deposition substrates in a vacuum coating processes, it is recognized that the coating will contain pin-holes, voids and other discontinuities. In fact, splitting or cracking of the coating through the thickness is a necessary part of the invention to manage the thermal stress associated with joining refractory metals to the carbon-carbon substrate. Splitting of the coating will be promoted by thermal cycling of the SiC-coated substrate in vacuum to about 2,500° C. A number of thermal cycles will provide sufficient stress relief in the silicon carbide coating at room temperature and the base layer for overcoating with refractory metals to form the focal track on a carbon-carbon composite substrate.

As provided by a further refinement of this embodiment, the adhesion promoting protective interlayer may thus consist of a controlled formation of silicon carbide coating cracks with the openings in-between said cracks being conformally filled with the refractory metal of said refractory metal overcoating layer. The invention hence leverages the tendency for cracking of the silicon carbide coated carbon composite during thermal cycling in order to enhance adhesion of the silicon carbide/refractory metal interlayers to the carbon-carbon composite substrate and focal track coatings by an interlocking mechanism.

A second exemplary embodiment of the present invention refers to an X-ray tube of the rotary anode type which comprises a light-weight hybrid anode disk structure as described above with reference to said first exemplary embodiment. Said anode may e.g. rotate at speeds in excess of 10,000 rpm and with a CT gantry period of rotation less than about 0.3 seconds. In a setup configuration of a practical X-ray tube device, which has to be designed to survive about $10^8$ large temperature cycles, adhesion of the tungsten-rhenium track can thus be maintained.

A third exemplary embodiment of the present invention is directed to a method for manufacturing a light-weight hybrid anode disk structure as described above with reference to said first exemplary embodiment. Said method thereby comprises the steps of exposing a carbon-carbon composite substrate realized by a carbon fiber reinforced carbon matrix substrate to a temperature which is high enough to remove binder constituents and increase the density of the carbon matrix by removal of the majority of void volume, depositing a thin adhesion promoting protective layer (e.g. made of silicon carbide) onto the inclined section of the carbon-carbon composite by applying a vacuum coating processing method, heating the anode substrate in high vacuum to a temperature in excess of the expected focal track temperature and then cooling it down for a given number of cycles. Said vacuum coating processing method may thereby be realized by a magnetron sputtering, RF ion plating or dual-ion beam deposition (DIBD) which is employed to fill cracks created in the silicon carbide layer during the process of thermal cycling. After that, a refractory metal overcoating layer, which may e.g. be given by a tantalum (Ta), hafnium (Hf), vanadium (V) or rhenium (Re) layer, may be vapor-deposited onto the silicon carbide layer on top of the carbon-carbon composite substrate. Finally, a coating layer made of a high-Z material forming a focal track, such as e.g. given by a tungsten-rhenium (W/Re) alloy, is attached on top of the refractory metal overcoating layer by vapor deposition. Said method thus allows a robust attachment of a high-Z focal track material as given by said tungsten-rhenium alloy to an inclined surface of a rotating anode target given in the form of a carbon-carbon composite substrate.

BRIEF DESCRIPTION OF THE DRAWINGS

These and other advantageous aspects of the invention will be elucidated by way of example with respect to the embodiments described hereinafter and with respect to the accompanying drawings. Therein.

DETAILED DESCRIPTION OF THE PRESENT INVENTION

In the following, the hybrid anode disk structure according to an exemplary embodiment of the present invention, compared to the relevant prior art, will be explained in more detail and with reference to the accompanying drawings.

Figure 1:
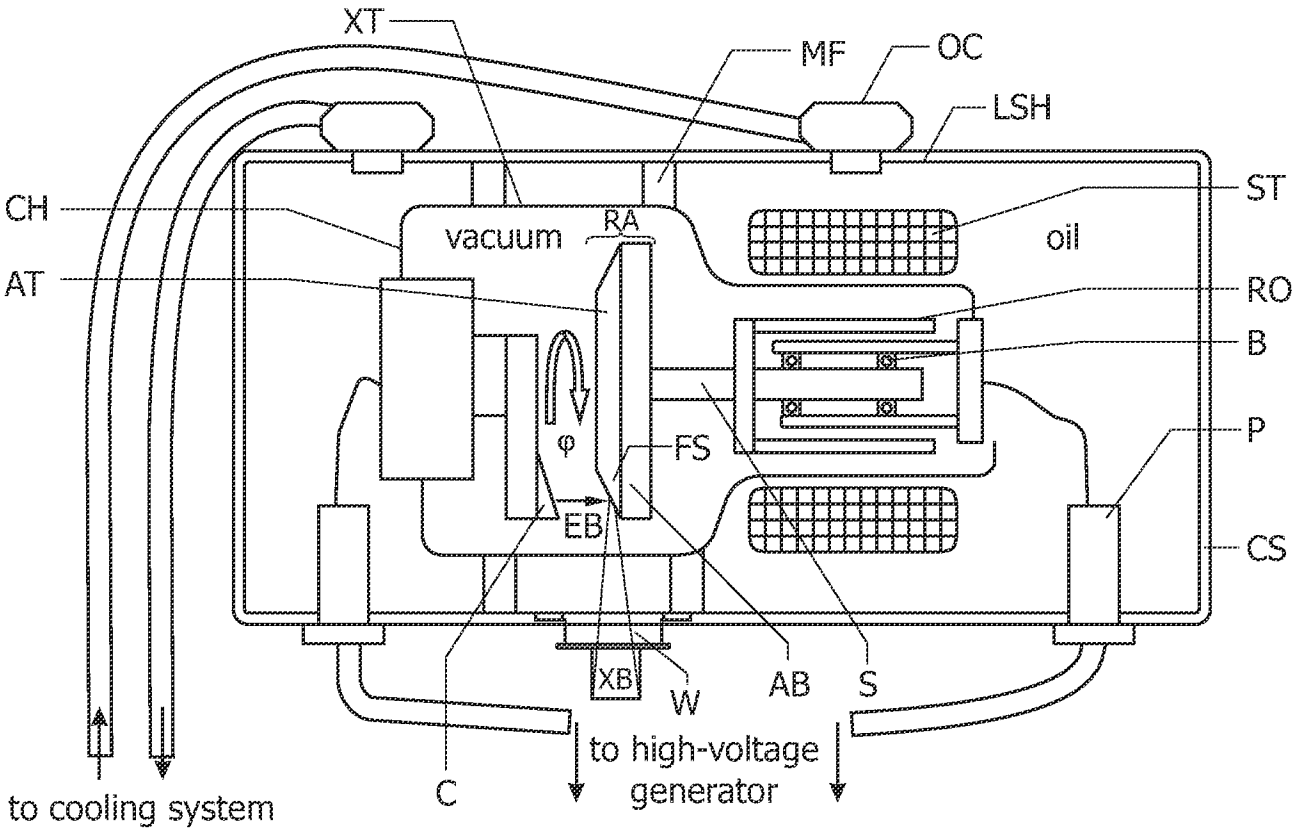
FIG. 1 (Prior Art)
FIG. 1 shows a cross-sectional view of a conventional rotary anode based X-ray tube as known from the prior art.

A schematic cross-sectional view of a conventional X-ray tube of the rotary anode type as known from the prior art is shown in FIG. 1. The X-ray tube comprises a stationary cathode C and a rotationally supported anode target AT fixedly attached to a rotary shaft S within an evacuated chamber CH given by a glass or metal-glass envelope. When being exposed to an electron beam EB of sufficient energy incident on a focal track region on an inclined surface of the anode target, said electrons being ejected from the anode target material due to a high voltage applied between the cathode and said anode, a conical X-ray beam XB is generated by the rotational anode target AT and emitted through a window W of a casing CS which contains the evacuated chamber.

Figure 2A:
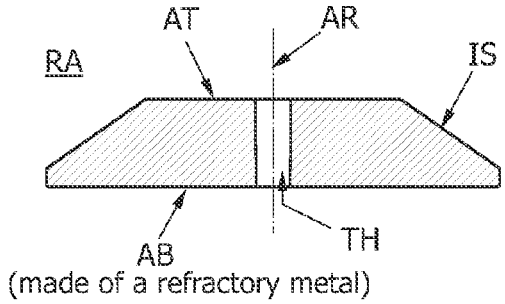
FIG. 2a (Prior Art)
FIG. 2*a* shows a cross-sectional view of a conventional rotary anode according to the prior art consisting of a single body made of a refractory metal.

A cross-sectional view of a conventional rotary anode RA according to the prior art consisting of an anode target AT formed by a single body AB which is made of a refractory metal (such as e.g. molybdenum, tungsten or a tungsten-rhenium alloy) is shown in FIG. 2*a*. The depicted anode has a centered through-hole TH which allows the anode target AT to be mounted on a rotary shaft (not shown) which rotates about the anode target's axis of symmetry (in the following also referred to as rotational axis AR). An annular range on an inclined surface IS of the anode target serves as a focal track when being exposed to an electron beam incident from a filament cathode (not shown) when applying a large voltage potential difference between the anode target and said cathode.

Figure 2B:
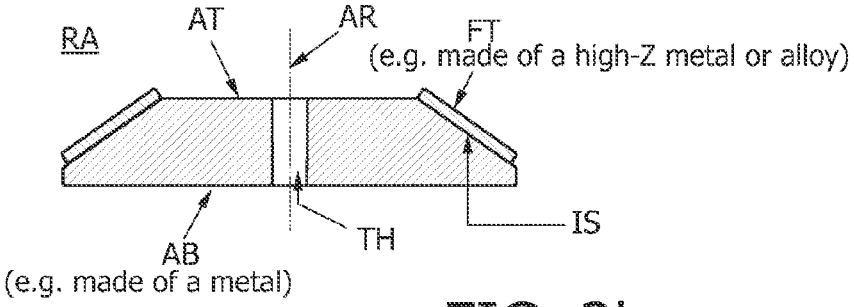
FIG. 2b (Prior Art)
FIG. 2*b* shows a cross-sectional view of a metal anode target according to the prior art with a focal track bonded to an inclined surface of the anode target.

In FIG. 2*b*, a cross-sectional view of another conventional rotary anode RA as known from the prior art is shown. As described above with reference to the prior-art setup configuration of FIG. 2*a*, the herein depicted anode also comprises an anode target AT formed by a single body AB which may be made of a metal. Contrary to the embodiment shown in FIG. 2*a*, however, an X-ray emissive metal layer forming a focal track FT is bonded to an annular region on an inclined surface IS of the anode target.

Figure 2C:
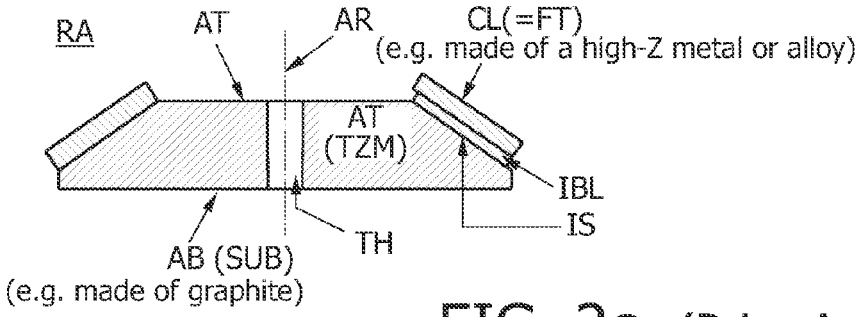
FIG. 2c (Prior Art)
FIG. 2*c* shows a cross-sectional view of a graphite anode target overcoated by a metal focal track layer with an intermediate bonding layer attached to an inclined surface of the anode target lying in-between as known from the prior art.

A cross-sectional view showing a further setup configuration of a conventional rotary anode RA according to the prior art is depicted in FIG. 2*c*. The herein depicted anode comprises an anode target AT formed by a single body AB which is made of a graphite substrate SUB. According to this setup configuration, an intermediate bonding layer IBL is attached to an inclined surface IS of the anode target. This bonding layer may thereby be overcoated by an X-ray emissive target material given by a high-Z refractory metal or alloy (herein also referred to as coating layer CL) which constitutes a focal track layer FT.

Figure 2D:
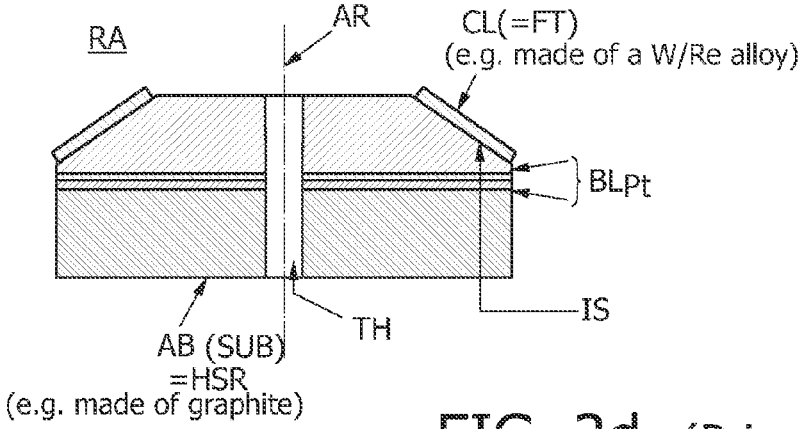
FIG. 2d (Prior Art)
FIG. 2*d* shows a cross-sectional view of a further rotational anode as known from the prior art with a titanium-zirconium-molybdenum (TZM) cap serving as an anode target, wherein said anode target is bonded to a heat storage ring given by a graphite substrate.

In FIG. 2*d*, a cross-sectional view of a conventional setup configuration for a further rotary anode as known from the prior art is shown. The depicted anode thereby comprises an anode target AT with a titanium-zirconium-molybdenum (TZM) cap serving as an anode target. As can be taken from FIG. 2*d*, the anode target is bonded to a heat storage ring HSR forming the anode body AB which may e.g. be given by a graphite substrate SUB. Furthermore, an X-ray emissive metal layer forming a focal track FT is bonded to an annular region on an inclined surface IS of the anode target.

Figure 3:
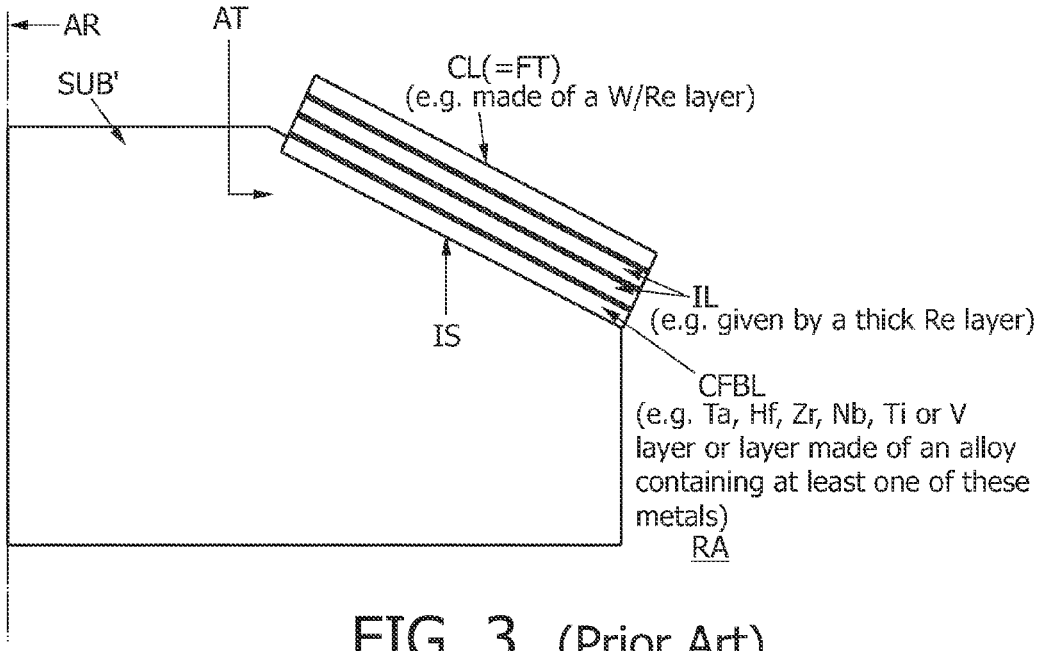
FIG. 3 (Prior Art)
FIG. 3 shows a cross-sectional view of a rotary anode's setup configuration as taught in U.S. Pat. No. 6,430,264 B1.

In FIG. 3, a cross-sectional view of a rotary anode as taught in U.S. Pat. No. 6,430,264 B1 is shown. The depicted setup configuration comprises a carbon fiber reinforced carbon matrix substrate SUB' serving as an anode target AT with an inclined surface IS to which a carbide forming bonding layer CFBL given by a thin tantalum (Ta), hafnium (Hf), zirconium (Zr), niobium (Nb), titanium (Ti) or vanadium (V) layer having a thickness between about 1 μm and 2 μm or a layer made of an alloy containing at least one of these metals followed by a 30 μm thick interlayer IL made of rhenium (Re) is attached in an annular region of the inclined anode surface. According to the herein depicted setup configuration, said interlayer IL is overcoated by an X-ray emissive tungsten-rhenium (W/Re) layer with a thickness of about 250 μm constituting a focal track FT.

The prior art describes three general concepts for attaching an X-ray emissive focal track layer to a carbon substrate using (I) single layer for bonding and function, (II) one interlayer for promoting adhesion between the substrate and functional layer, and (III) a third configuration with an additional layer to serve as a carbon-diffusion barrier layer between bonding and functional layers. The latter is appears used in the highest temperature applications although long-term stability of the functional layer requires that carbide formation not occur to any significant degree. These configurations summarize most of the various applications teaching a bonding of a functional layer to a carbon substrate. These applications include: a) joining of carbon electrodes, b) erosion control of carbon component for nuclear reactors, c) bonding of metal carbides to a graphite anode target, d) bonding of a graphite heat storage ring to molybdenum alloy anode target cap, e) oxidation resistant coatings with bonding and diffusion barrier to carbon composite for turbine engine blades, f) anti-reflection coatings with planarization and bonding layers to carbon composite mirrors, and g) refractory metal track coating to a carbon-carbon composite substrate with bonding and carbon-diffusion barrier layers.

Figure 4A:
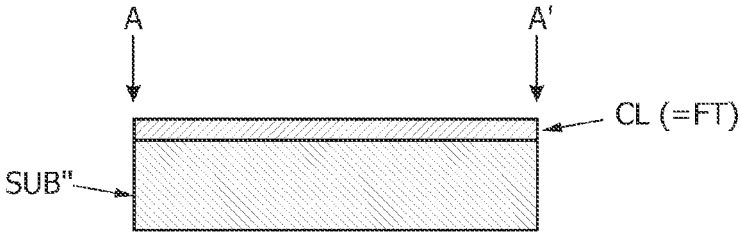
FIG. 4a (Prior Art)
FIGS. 4*a-c* show three exemplary layer structures as known from the prior art for attaching a high-Z metal or alloy forming a focal track layer to a graphite or carbon-carbon composite substrate.
Figure 4B:
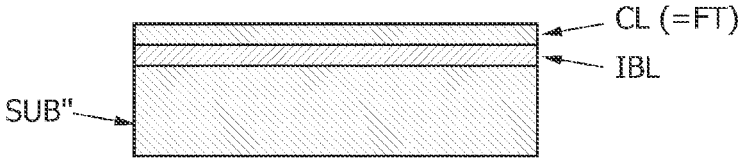
FIG. 4b (Prior Art)
Figure 4C:
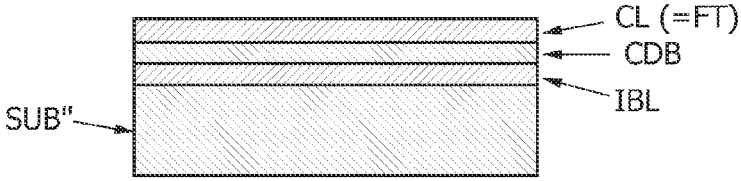
FIG. 4c (Prior Art)

FIGS. 4*a-c* show three exemplary layer structures as known from the prior art for attaching a high-Z metal or alloy forming a focal track layer to a graphite or carbon-carbon composite substrate. In FIG. 4*a*, which realizes a setup configuration as proposed by concept No. I, a coated graphite or carbon-carbon composite substrate SUB" with a single coating layer CL bonded to an upper surface of said substrate which serves as an X-ray emissive target material forming a focal track layer FT is shown. FIG. 4*b*, which realizes a setup configuration as proposed by concept No. II, illustrates a coated graphite or carbon-carbon composite substrate SUB" with a single interlayer coating IBL to which an X-ray emissive target material forming a focal track layer FT is bonded. A coated graphite or carbon-carbon composite substrate SUB" with a single interlayer coating IBL bonded to said substrate followed by a carbon diffusion barrier CDB and a coating layer CL attached on top of this diffusion barrier layer, said coating layer being made of an X-ray emissive target material constituting a focal track layer FT such as proposed by concept No. III is shown in FIG. 4*c*.

Figure 5:
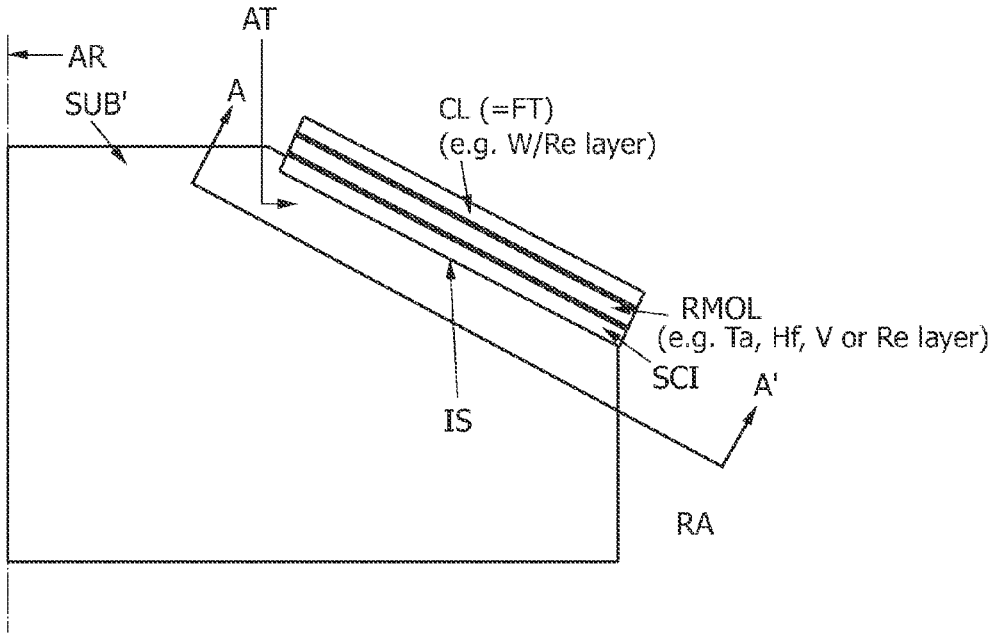
FIG. 5 shows a light-weight hybrid anode disk structure for a rotary anode according to the present invention with an adhesion promoting protective silicon carbide (SiC) interlayer deposited onto a rotary X-ray tube's anode target which, as proposed by the present invention, comprises a refractory metal overcoating layer attached to the silicon carbide layer and a tungsten-rhenium (W/Re) alloy forming a focal track layer deposited onto said overcoating layer.

FIG. 5 shows a light-weight hybrid anode disk structure for a rotary anode RA according to the present invention. The rotary anode target consists of a carbon-carbon composite substrate disk SUB' which is rotated about its axis of symmetry AR. An adhesion promoting protective silicon carbide (SiC) interlayer is vapor-deposited to an annular range on an inclined surface IS of the anode target, followed by a refractory metal overcoating layer RML which may e.g. be realized as a tantalum (Ta), hafnium (Hf), vanadium (V) or rhenium (Re) layer interpenetrating the split regions of the silicon carbide interlayer SCI. As can be taken from FIG. 5, said refractory metal overcoating layer RML may be overcoated by a high-Z coating layer CL made of a tungsten-rhenium (W/Re) alloy which forms an X-ray emissive focal track FT.

Figure 6:
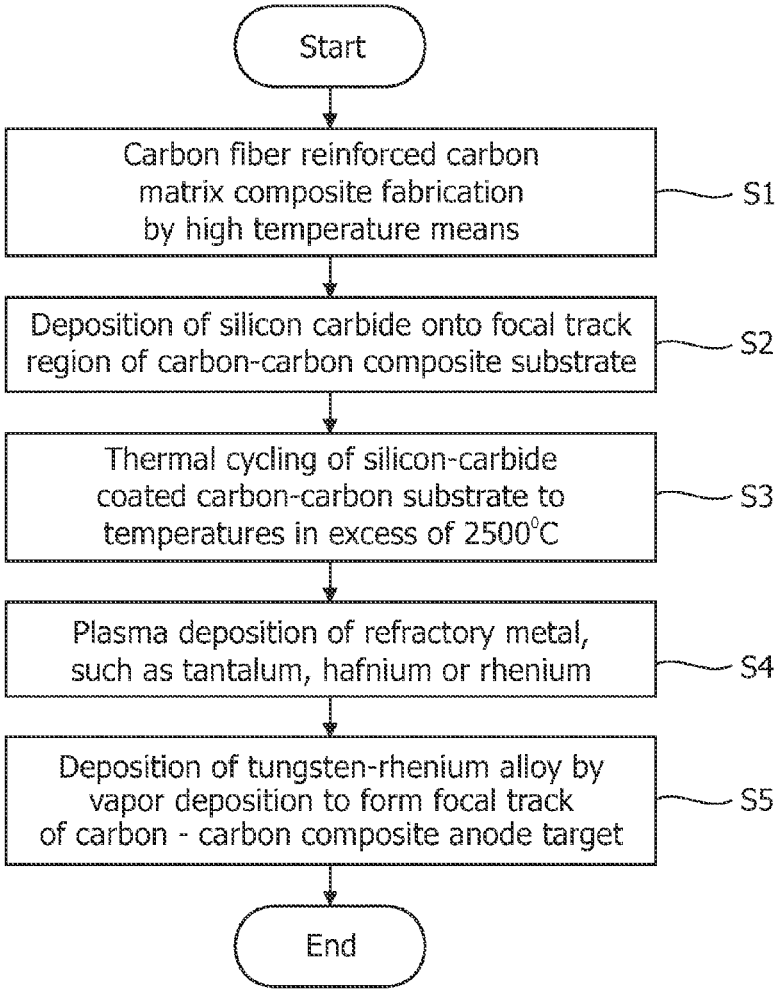
FIG. 6 shows a flow chart for illustrating the proposed method of manufacturing the light-weight hybrid anode disk structure depicted in FIG. 5.

FIG. 6 shows a flow chart for illustrating the proposed method of manufacturing the light-weight hybrid anode disk structure depicted in FIG. 5. Firstly, a carbon-carbon composite substrate given by a carbon fiber reinforced carbon matrix substrate is fabricated and densified through exposure (S1) to high temperatures so as to remove binder constituents and increase the density of the carbon matrix by removal of the majority of void volume. After that, a thin layer of silicon carbide (SiC) of about 1 μm thickness is deposited (S2) by vacuum coating processing methods onto the inclined section of the carbon-carbon composite. The anode substrate is then heated (S3*a*) for approximately one hour in high vacuum to temperatures in excess of the expected focal track temperature (~2,500° C.) and then cooled (S3*b*) while maintaining high vacuum.

This cycle of heating to high temperature, soak at high temperature and then cooling down will be repeated in high vacuum for a given number of cycles (e.g. between 3 and 10 times). Following temperature cycling, a relatively thick coating (~10 μm) of refractory metal, such as e.g. tantalum (Ta), hafnium (Hf), vanadium (V) or rhenium (Re), will be vapor-deposited (S4) onto the silicon carbide area of the carbon-carbon composite substrate. Thereby, vacuum deposition by magnetron sputtering, RF ion plating or dual-ion beam deposition (DIBD) may be employed to fill cracks created in the silicon carbide layer during thermal cycling. The latter method will be described below by virtue of very high coating nucleation density and reasonable deposition rates as obtained when applying the DIBD method. The refractory metal overcoating layer will be sufficiently thick to form a continuous metal layer. Finally, chemical vapor deposition (or other vacuum deposition process) will be used to deposit the tungsten-rhenium (W/Re) layer forming the focal track region comprised on top of the refractory metal interlayer (S5). It should be noted that this flow chart is merely provided as an example which does not exclude similar methods.

Figure 7:
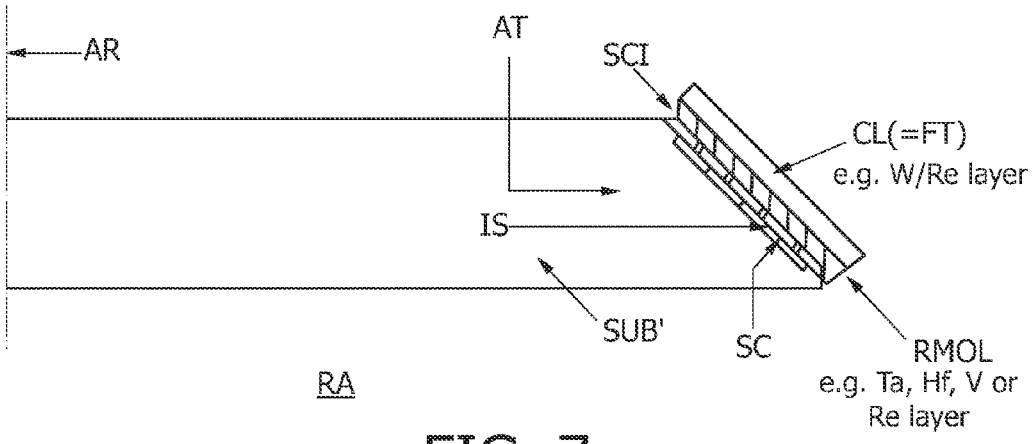
FIG. 7 shows a more detailed view of the focal track region as described with reference to this light-weight hybrid anode disk structure.

A more detailed view of the focal track region as described with reference to the light-weight hybrid anode disk structure presented in FIG. 5 is shown in FIG. 7. The focal track region thereby forms a relatively thin annulus section on the inclined surface IS of the carbon-carbon composite substrate SUB' forming the anode target. As can be taken from FIG. 7, a silicon carbide interlayer SCI containing a plurality of coating cracks SC perpendicularly extending through the entire thickness of this layer is attached to the inclined surface IS. The number and pattern of through-thickness cracks depends on the residual coating stress, temperature cycling process, as-deposited coating defects, surface condition and carbon-composite material properties. A refractory metal overcoating layer RML, which may e.g. be realized by a tantalum (Ta), hafnium (Hf), vanadium (V) or rhenium (Re) layer, interpenetrates the coating cracks SC and may be sufficiently thick to form a continuous encapsulating layer of the silicon carbide coating. As can be seen from FIG. 7, a thick coating layer made of a high-Z material, which may e.g. be realized as a tungsten-rhenium (W/Re) alloy layer, is vapor-deposited onto the refractory metal overcoating layer RML and serves as an X-ray emissive focal track FT.

To manufacture a light-weight hybrid anode disk structure as described with reference to the exemplary embodiment depicted in FIG. 7, a carbon fiber reinforced composite substrate is formed with a fiber pre-form optimized for use as a rotating disk with a diameter of about 300 mm or less while rotating intermittently at 30,000 rpm and subject to loading with thermal excursions up to a bulk temperature of 2,000° C. and rapid accelerations and de-acceleration as a result of gantry scan time of less than 0.3 seconds. This may involve a pre-form of PAN fiber tows with circumferential banding, z-direction ties to obtain high strength and high thermal conductivity through the carbon-carbon composite substrate. The substrate will likely contain a central through-hole for attachment to an anode bearing shaft and may accommodate the inclined region on the substrate perimeter for the placement of the focal track coatings and interlayers.

A carbon-carbon composite substrate is produced with the above pre-form and obtains densification by high temperature cycles of thermal decomposition of binder materials and graphitization, followed by chemical vapor infiltration. This will include heat treatments at temperatures between 2,500° C. and 3,000° C. Even in the near-net shape configuration, machining of the composite of the substrate will be necessary to achieve the tight dimensional tolerances associated with rotary anode target and for planarizing the inclined focal track region. It is recognized that residual porosity is present in carbon-carbon composite substrates, which presents several challenges to produce a useful article: forming a coherent focal track coating, out-gassing vacuum during processing and final fabrication of the anode target, which includes precision balancing of the anode assembly. Substrate out-gassing will also be difficult in vacuum depositing a thin silicon carbide interlayer onto the focal track region of the substrate.

A critical aspect of the interlayer deposition on the carbon-carbon composite substrate is to apply the silicon carbide coating onto the article heated to nearly 2,500° C. in high vacuum. Heating can be achieved by a number of means consistent with high vacuum processing technology, including the use of an induction coil operating at 100 kHz to 500 kHz frequency and approximately 5 kW power. Alternatively, the substrate may be heated by ion bombardment in an inert gas plasma (e.g. argon), operating at 100 mtorr to 10 torr pressure, with RF- or DC-pulsed excitation, in which the substrate is negatively biased at a voltage potential of about 1 kV to accelerate ions to the carbon substrate. The latter is the preferred method, since it will etch the carbon composite surface and allow for an adherent silicon carbide layer while heating the substrate to high temperature. Appropriate tooling is required for this process step with several features: a) masking of all areas of the substrate, absent the focal track region, b) minimizing thermal conduction of the substrate to the vacuum chamber, and c) electrical connection to high bias potential without a grounding path.

It is essential for this invention that the silicon carbide layer is deposited onto a highly heated substrate. This is to insure that thermally-induced stresses between the substrate and silicon carbide layer are minimized for the anode target use temperature and to create large tensile stresses in the layer at room temperature. Large residual thermal stresses $\sigma_0$ of about 2 GPa are expected in the layer on cooling from about 2,500° C. to room temperature due to the thermal expansion mismatch between silicon carbide and the carbon-carbon composite substrate, which can be calculated as follows:

$$\sigma_o = E\Delta\alpha\Delta T \cdot \frac{1}{1-\nu}$$

In this equation, E is Young's modulus of silicon carbide (370 kN·mm$^{-2}$), $\nu$=0.25 is Poisson's ratio of the coating, $\Delta\alpha$ denotes the difference thermal expansion coefficient between the layer and substrate materials (~2·10$^{-6}$° C.$^{-1}$), and $\Delta T$ is the change in substrate temperature during deposition and room temperature. Material data for this purpose is available in standard texts on materials engineering (e.g. Ashby, M., and Jones, D. R. H., *Engineering Materials 2: An Introduction to Microstructures, Processing and Design*, Butterworth-Heinemann; 3$^{th}$ Ed., 2005). A silicon carbide (SiC) layer of approximately 1 μm thickness can be deposited onto the heated substrate by magnetron sputtering, in the presence of argon at lower pressure than used for the heating step, using vacuum process procedures available in the literature (e.g. Vossen, J. L., and Kern, W., *Thin Film Processes II*, Boston Academic Press, 1991).

Cracks will appear in the silicon carbide layer on cooling from the deposition temperature as a result of the large residual tensile stresses. This is a commonly understood by those practicing the art of coating carbon composites, most frequently with the application of forming an oxidation resistant coating in air at high temperature. This invention relies on the formation of these cracks in the coating to relieve thermal stresses and to provide an interlocking network base coating onto which the refractory focal track layers are applied. The specific fracture pattern in the coating is not critical for this invention, rather the crack density (per unit area) to relieve residual thermal stresses below the crack driving force for splitting or delaminating the coating. In both cases of film splitting and delamination, the driving force scales with coating thickness h. Nominally, the crack density should exceed 100 h$^{-2}$, or greater than 100 μm$^2$ for a 1 μm thick coating. The reduction in crack driving force with film segment size, follow from detailed consideration of thermal film stresses (Drory, M. D., Thouless, M. D., and Evans, A. G., *Acta Metallurgica,* 36[8] (1988) 2019). Film splitting is encouraged by heating and cooling from 2,500° C. to room temperature in high vacuum through a number of cycles (e.g. between 3 and 10) to form a stable film splitting density. This can be performed in the same chamber for silicon carbide deposition or in a separate chamber with the capability of heating to high temperature in high vacuum (<10$^{-6}$ torrpressure).

A refractory metal overcoating layer is deposited onto the silicon carbide coated carbon-carbon composite substrate to fill the gaps in the coating created by the film splitting procedure, thereby forming a continuous layer over in the focal track region. The refractory coating may preferably be given by tantalum (Ta) or any other refractory metal of high melting temperature, e.g. hafnium (Hf), vanadium (V) or rhenium (Re). A 10 μm thick layer of tantalum can be applied by several methods. However, techniques which have high nucleation density and deposition rate are preferred to fill the void space in the coating created by the film splitting procedure or are present as residual porosity in the carbon substrate matrix. A high deposition rate provides greater sample through-put in production, thereby favored for an economical process. The preferred coating processes for this purpose are RF-ion plating or dual-ion beam deposition. RF ion plating is taught for a DC-based process (see U.S. Pat. No. 3,329,601), and for RF source in ion plating (cf. Mattox, D. M., *Journal of Vacuum Science and Technology,* 10[1] (1973) 47). Dual-ion beam deposition has advantages over a single ion source and other forms of sputtering. One beam is for ballistic collision and sputtering of the material source, while a second beam provides for concurrent ionization of the source beam to vary the atom-to-ion ratio. In this context, a key factor is forming dense coatings and controlling deposition-related stresses such as taught in U.S. Pat. No. 5,055,318.

APPLICATIONS OF THE PRESENT INVENTION

The proposed invention provides a light-weight hybrid anode disk structure for use in an X-ray tube of the rotary-anode type that can advantageously be applied for material inspection or medical radiography as well as a method for manufacturing such an anode by robustly attaching a high-Z focal track material to a carbon-carbon composite substrate. Furthermore, the invention is a unique solution which enables practical use of carbon-carbon composites as a light-weight anode target. The invention can especially be applied in those application scenarios where it is necessary to enhance the resistance to carbon diffusion from the carbon-carbon anode substrate material in an annular region on an inclined surface of the anode target to a focal track region given by an outer coating layer made of a tungsten-rhenium (W/Re) alloy where said carbon diffusion would else lead to an embrittlement of the anode target by formation of tungsten carbide (WC).

While the present invention has been illustrated and described in detail in the drawings and in the foregoing description, such illustration and description are to be considered illustrative or exemplary and not restrictive, which means that the invention is not limited to the disclosed embodiments. Other variations to the disclosed embodiments can be understood and effected by those skilled in the art in practicing the claimed invention, from a study of the drawings, the disclosure and the appended claims. In the claims, the word "comprising" does not exclude other elements or steps, and the indefinite article "a" or "an" does not exclude a plurality. Furthermore, it is to be noted that any reference signs in the claims should not be construed as limiting the scope of the invention.

The invention claimed is:

1. A light-weight hybrid anode disk structure for an X-ray tube of the rotary-anode type, said anode disk structure having an anode target which comprises a carbon composite substrate disk, an adhesion promoting protective interlayer vapor-deposited to an annular range on an inclined surface of said anode target, followed by a refractory metal overcoating layer attached on top of said interlayer, and a high-Z coating layer deposited onto top of said refractory metal overcoating layer, said coating layer forming an X-ray emissive focal track when being exposed to an incident X-ray beam with sufficient kinetic energy, wherein said carbon composite substrate disk is fabricated of a carbon composite having a thermal expansion coefficient lower than that of silicon carbide (SiC).

2. The light-weight hybrid anode disk structure according to claim 1, wherein said high-Z coating layer is made of a tungsten-rhenium (W/Re) alloy.

3. The light-weight hybrid anode disk structure according to claim 1, wherein the refractory metal overcoating layer is made of a tantalum (Ta), hafnium (Hf), vanadium (V) or rhenium (Re) layer.

4. The light-weight hybrid anode disk structure according to claim 1, wherein said adhesion promoting protective interlayer is realized as a silicon carbide layer.

5. The light-weight hybrid anode disk structure according to claim 1, wherein said carbon composite substrate disk is made of a carbon fiber reinforced carbon matrix substrate.

6. The light-weight hybrid anode disk structure according to claim 5, wherein said carbon fiber reinforced carbon matrix substrate comprises a number of incorporated polyacrylonitrile fiber tows, carbonized at approximately 1,500° C. and subsequently graphitized at a temperature between 2,500° C. and 3,000° C.

7. The light-weight hybrid anode disk structure according to claim 1, wherein said carbon composite substrate disk is made of mesophase pitch-based carbon fibers with carbon nanotube (CNT) reinforcements.

8. An X-ray tube of the rotary anode type comprising a light-weight hybrid anode disk structure according to claim 1.

9. A light-weight hybrid anode disk structure for an X-ray tube of the rotary-anode type, said anode disk structure having an anode target which comprises a carbon composite substrate disk, an adhesion promoting protective interlayer realized as a silicon carbide (SiC) layer vapor-deposited to an annular range on an inclined surface of said anode target, followed by a refractory metal overcoating layer attached on top of said silicon carbide interlayer, and a high-Z coating layer deposited onto top of said refractory metal overcoating layer, said coating layer forming an X-ray emissive focal track when being exposed to an incident X-ray beam with sufficient kinetic energy, comprising a controlled formation of silicon carbide coating cracks in the adhesion promoting protective interlayer with the openings in-between said cracks being conformally filled with the refractory metal of said refractory metal overcoating layer.

10. A method for manufacturing a light-weight hybrid anode disk structure for an X-ray tube of the rotary-anode type, said anode disk structure having an anode target which comprises a carbon composite substrate disk, an adhesion promoting protective interlayer vapor-deposited to an annular range on an inclined surface of said anode target, followed by a refractory metal overcoating layer attached on top of said interlayer, and a high-Z coating layer deposited onto top of said refractory metal overcoating layer, said coating layer forming an X-ray emissive focal track when being exposed to an incident X-ray beam with sufficient kinetic energy, said method comprising the steps of exposing a carbon-carbon composite substrate realized by a carbon fiber reinforced carbon matrix substrate to a temperature which is high enough to remove binder constituents and increase the density of the carbon matrix by removal of the majority of void volume, depositing a thin adhesion promoting protective layer onto the inclined section of the carbon-carbon composite substrate by applying a vacuum coating processing method, heating the substrate in high vacuum to a temperature in excess of the expected focal track temperature and then cooling it down for a given number of cycles, vapor-depositing a refractory metal overcoating layer onto the adhesion promoting protective layer on top of the carbon-carbon composite substrate, and attaching a coating layer made of a high-Z material forming a focal track on top of the refractory metal overcoating layer by vapor deposition.

11. The manufacturing method according to claim 10, wherein said vacuum coating processing method is realized by a magnetron sputtering, radio frequency (RF) ion plating or dual-ion beam deposition (DIBD) which is employed to fill cracks created in the silicon carbide layer during the process of thermal cycling.

12. The manufacturing method according to claim 10, wherein the high-Z material of said coating layer is given by a tungsten-rhenium (W/Re) alloy.

13. The manufacturing method according to claim 10, wherein the refractory metal overcoating layer is made of a tantalum (Ta), hafnium (Hf), vanadium (V) or rhenium (Re) layer.

14. The manufacturing method according to claim 10, wherein said adhesion promoting protective interlayer is realized as a silicon carbide layer.

15. The manufacturing method according to claim 10, wherein said carbon composite substrate disk is fabricated of a carbon composite having a thermal expansion coefficient lower than that of silicon carbide (SiC).

16. The manufacturing method according to claim 15, wherein said carbon composite substrate disk is made of a carbon fiber reinforced carbon matrix substrate.

17. The manufacturing method according to claim 16, wherein said carbon fiber reinforced carbon matrix substrate comprises a number of incorporated polyacrylonitrile fiber tows, carbonized at approximately 1,500° C. and subsequently graphitized at a temperature between 2,500° C. and 3,000° C.

18. The manufacturing method according to claim 15, wherein said carbon composite substrate disk is made of mesophase pitch-based carbon fibers with carbon nanotube (CNT) reinforcements.

* * * * *